US005683054A

United States Patent [19]

Chen

[11] Patent Number: 5,683,054

[45] Date of Patent: Nov. 4, 1997

[54] WIRE WINDING WHEEL

[76] Inventor: Tsang-I Chen, Rm. 707 Kang Ning Bldg., 293 Sung Chiang Rd., Taipei, Taiwan

[21] Appl. No.: 698,678

[22] Filed: Aug. 16, 1996

[51] Int. Cl.[6] ..... B65H 75/48

[52] U.S. Cl. ..... 242/376; 242/379; 242/609.2

[58] Field of Search ..... 242/376, 379.1, 242/379.2, 379, 385, 385.1, 385.2, 385.3, 385.4, 371, 375, 377, 609.1, 609.2; 191/12.2 R, 12.2 A, 12.4

[56] References Cited

U.S. PATENT DOCUMENTS

| | | | |
|---|---|---|---|
| 3,049,317 | 8/1962 | Kessler | 242/385.4 |
| 3,542,172 | 11/1970 | Meletti | 191/12.2 R |
| 3,617,659 | 11/1971 | Freeman | 191/12.2 R |
| 3,743,208 | 7/1973 | Schmitz | 242/609.2 |
| 3,813,501 | 5/1974 | Meletti et al. | 191/12.2 R |
| 4,227,661 | 10/1980 | King et al. | 242/385.2 |
| 4,725,697 | 2/1988 | Kovacik et al. | 191/12.4 |
| 4,736,538 | 4/1988 | Kovacik et al. . | |

*Primary Examiner*—John M. Jillions
*Attorney, Agent, or Firm*—Browdy and Neimark

[57] ABSTRACT

A wire winder comprises a first pulley, a second pulley, a spiral spring, a shaft on which the first pulley and the second pulley are mounted, a first housing for housing the first pulley, and a second housing for housing the second pulley. The first pulley is composed of a first disk and a hollow first cylindrical body fastened at one end thereof with one side of the first disk. The first cylindrical body is provided in the wall thereof with a plurality of ribs having an axial hole. The spiral spring is received in the first cylindrical body. The second pulley is composed of a second disk and a hollow second cylindrical body fastened at one end thereof with one side of the second disk. The second cylindrical body is provided in the wall thereof with a plurality of through holes corresponding in location to the axial holes of the ribs of the first cylindrical body for receiving the fastening screws which are engageable with the axial holes of the ribs.

7 Claims, 4 Drawing Sheets

WIRE WINDING WHEEL

FIELD OF THE INVENTION

The present invention relates generally to a wire winder, and more particularly to an extension cord winding wheel.

BACKGROUND OF THE INVENTION

The conventional wire winding device is generally composed of a housing in which a reel and a ratchet mechanism are housed. The reel has a tubular body for winding the wire, a spiral spring, and two flanges for confining the wound wire and for preventing the detachment of the spiral spring from the tubular body. The wire winding wheel disclosed in the U.S. Pat. No. 4,726,538 is the case in point. The wire winding wheel of the above-mentioned U.S. Patent is more refined in construction than the conventional wire winding devices in existance and is composed of a tubular body made integrally of a plastic material. The tubular body is provided at the center of one end thereof with a flange and at another end thereof with an opening for receiving a spiral spring. The opening is provided with a plurality of locking tabs engageable with the retaining hole of a pulley. In such a prior art wire winding wheel as described above the locking tabs are vulnerable to damage, and the locking tabs and the retaining hole must be constructed with precision so as to enable them to engage securely.

SUMMARY OF THE INVENTION

The primary objective of the present invention is therefore to provide a wire winding wheel devoid of the shortcomings of the prior art wire winding wheel described above.

The features of the present invention will be readily understood upon a thoughtful deliberation of invention in conjunction with the accompanying drawings.

DETAILED DESCRIPTION OF THE INVENTION

The wire winding wheel of the present invention comprises the component parts, which are described hereinafter.

Figure 1:
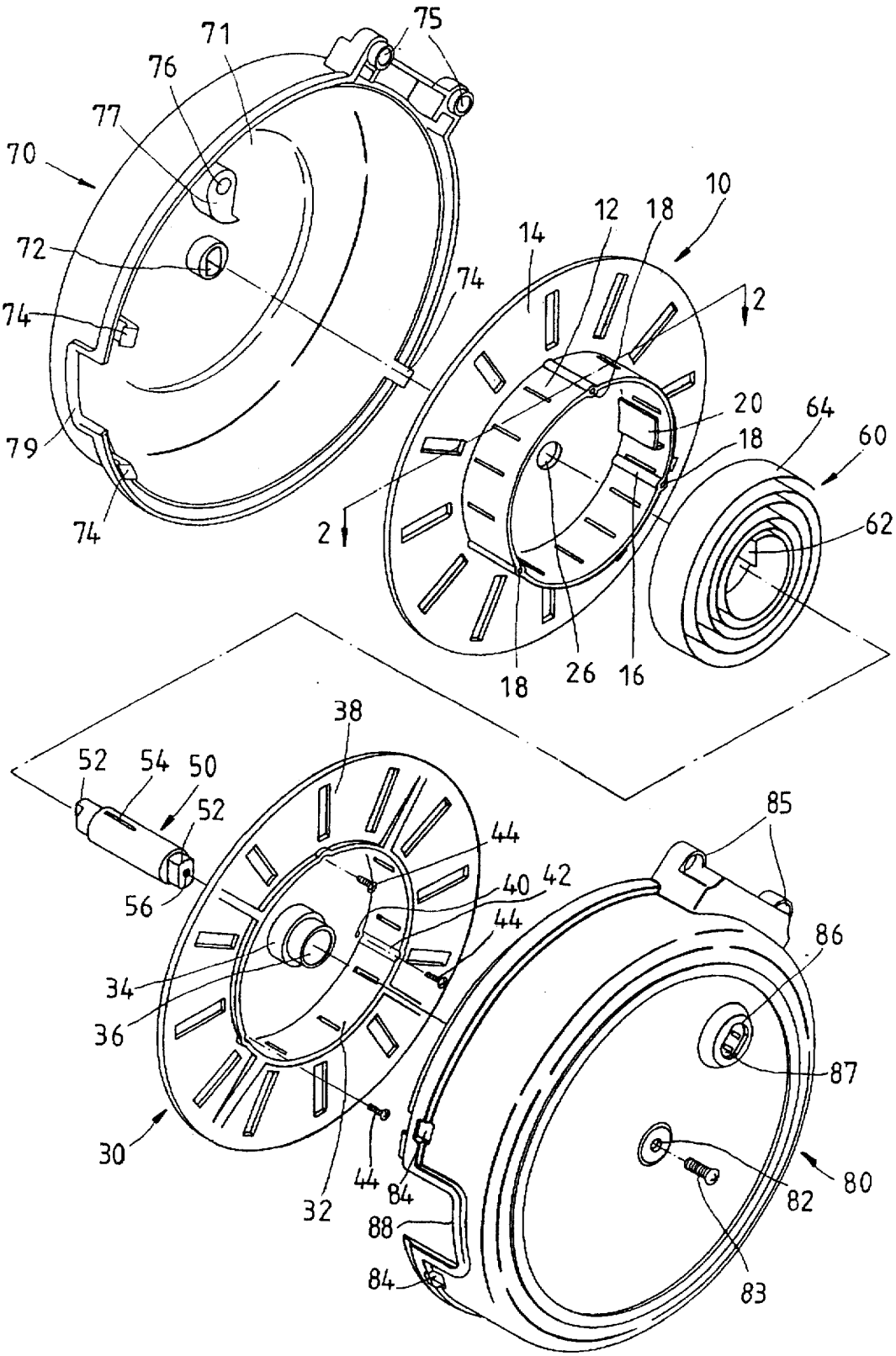
FIG. 1 shows an exploded view of the present invention.
Figure 2:
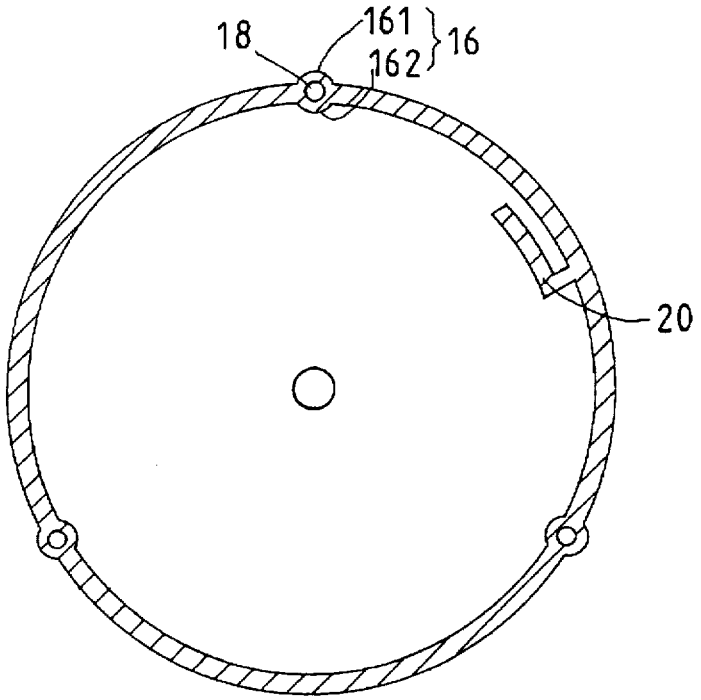
FIG. 2 shows a sectional view of a portion taken along the direction indicated by a line 2—2 as shown in FIG. 1.
Figure 5:
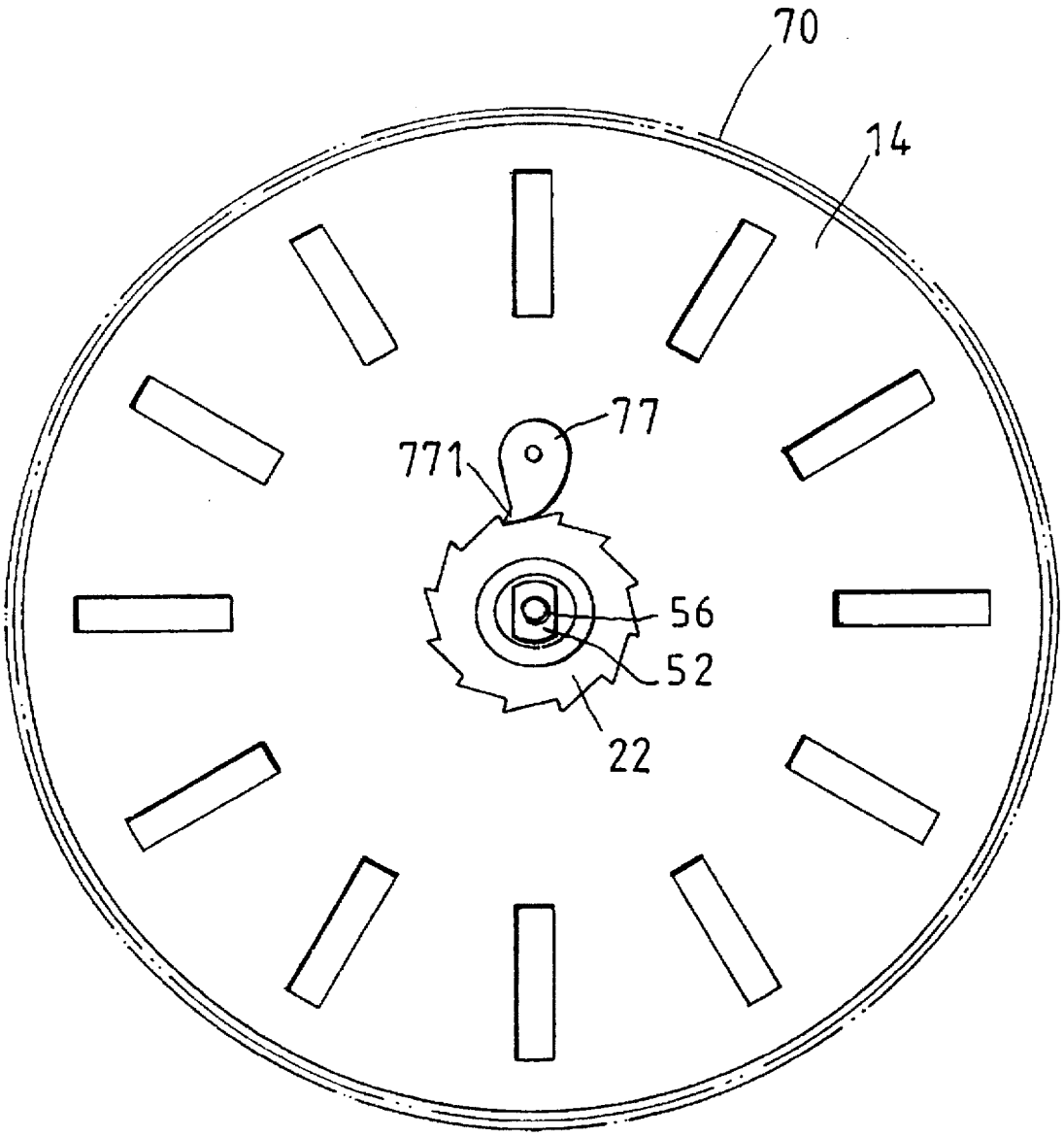
FIG. 5 shows a plan view of the present invention, with the first housing being indicated by the dotted line.

A first pulley 10 is made integrally of a plastic material by injection molding and is composed of a hollow first cylindrical body 12 and a first disk 14 fastened with one end of the cylindrical body 12. The first cylindrical body 12 is provided on the inner wall thereof with a plurality of ribs 16 which are arranged equidistantly. Each rib 16 is composed of two arcuate portions 161 and 162 opposite in location to each other, and an axial hole 18, as shown in FIG. 2. The first cylindrical body 12 is further provided on the inner wall thereof with a baffle 20 fastened therewith. The first pulley 10 is additionally provided with a ratchet wheel 22 fastened therewith such that the ratchet wheel 22 is opposite in location to the first cylindrical body 12, as shown in FIG. 5. The first disk 14 is provided at the center thereof with a shaft hole 26 for receiving a shaft 50, which is provided respectively at both ends thereof with a retaining portion and is further provided with a slot 54 of a predetermined dimension and extending in the direction of the longitudinal axis of the shaft 50.

A spiral spring 60 is joined with the first pulley 10 such that the spiral spring 60 is embraced by the first cylindrical body 12, and that a curved portion 62 of the inner end of the spiral spring 60 is engaged with the slot 54 of the shaft 50 on which the first pulley 10 is mounted, and further that the outer end 64 of the spiral spring 60 is received in a space located between the baffle 20 and the inner wall surface of the first cylindrical body 12.

A second pulley 30 is made integrally of a plastic material by injection molding and is composed of a hollow second cylindrical body 32 similar in diameter to the first cylindrical body 12, and a second disk 38 fastened with one end of the second cylindrical body 32. The second cylindrical body 32 is provided in the inner wall thereof with a plurality of through holes 40 corresponding in location and number to the axial holes 18 of the first cylindrical body 12 of the first pulley 10. Each through hole 40 has an arcuate portion 42 and is intended to receive a screw 44 engageable with the axial hole 18. The second cylindrical body 32 is provided in the center of the closed end thereof with a hub 34 fastened therewith and provided with an axial hole 36 engageable with a shaft 50.

A first housing 70 is made integrally of a plastic material by injection molding and is provided with a first receiving space 71 for housing the first pulley 10. Similarly, a second housing 80 is made integrally of a plastic material by injection molding and is provided with a second receiving space 81 for housing the second pulley 30. The first housing 70 is further provided in the side wall thereof with a cutout 79 while the second housing 80 is similarly provided in the side wall thereof with a cutout 88 corresponding in location to the cutout 79 for forming together a hole through which a wire 66 is pulled out. The first receiving space 71 has a retaining hole 72 engageable with the retaining portion 52 of the shaft 50 while the second receiving space 81 is provided with a retaining hole 82 engageable with another retaining portion 52 of the shaft 50. The first pulley 10, the second pulley 30, the first housing 70, and the second housing 80 are further secured together by two screws 73 and 83, which are engaged with the threaded holes 56 of the retaining portions 52 of the shaft 50. In addition, the first housing 70 is provided on the side wall edge of the open end thereof with a plurality of retaining projections 74 while the second housing 80 is similarly provided in the side wall edge of the open end thereof with a plurality of retaining slots 84 engageable securely with the retaining projections 74. Moreover, the first housing 70 and the second housing 80 are provided respectively in the outer walls thereof with a plurality of fastening holes 75, 85. The first housing 70 is further provided on the wall of the closed end thereof with a pin 76 fastened therewith for pivoting an arrester 77 capable of being caused by a spring (not shown in the drawings) to turn toward the shaft 50 such that its arresting end 771 is engaged with the ratchet wheel 22 for locating the wire 66. The second housing 80 has a receiving hole 86 for retaining a receptacle 87.

In combination, an electrical connection element is first disposed in the second cylindrical body 32 for connecting the wire 66 and the receptacle. When the wire 66 is pulled out of the housings, the first pulley 10 and the second pulley 30 are actuated so as to bring about the tightening of the spiral spring 60. In the meantime, the arresting end 771 of the arrester 77 is engaged with the ratchet wheel 22. As the ratchet wheel 22 is relieved of the arresting action of the arrester 77, the first and the second pulleys 10 and 30 are caused by the rebounding force of the spiral spring 60 to turn in reverse to pull back the wire 66.

As described above, all component parts of the wire winding wheel are fastened securely without the deficiencies of the wire winder of the prior art. For example, the first pulley 10 and the second pulley 30 are held securely together by screws 44 engaging the axial holes 18 and the through holes 40. Furthermore, the first pulley 10 and the second pulley 30 are further secured by the first housing 70 and the second housing 80, which are held securely by the retaining projections 74 engaging the retaining slots 84. In addition, the first housing 70 and the second housing 80 are still further held securely together by the fastening holes 75 and 85 engageable with the fastening screws.

Figure 4:
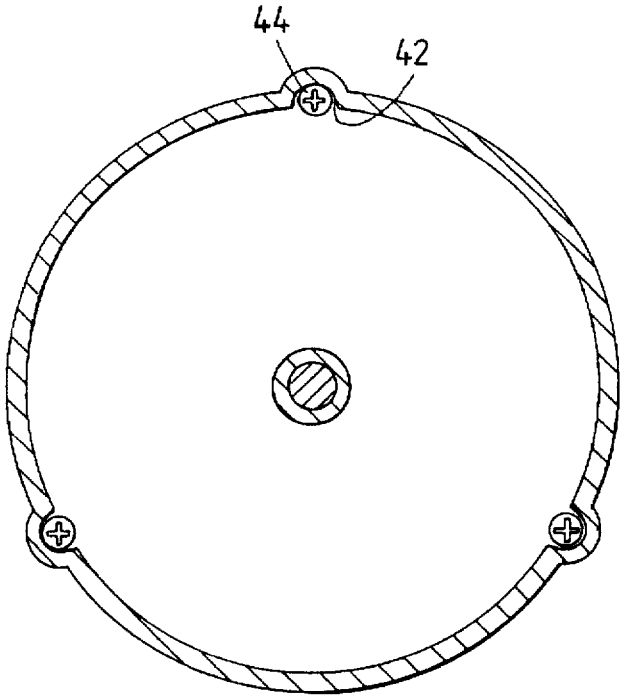
FIG. 4 shows a sectional view of a portion taken along the direction indicated by a line 4—4 as shown in FIG. 3.
Figure 3:
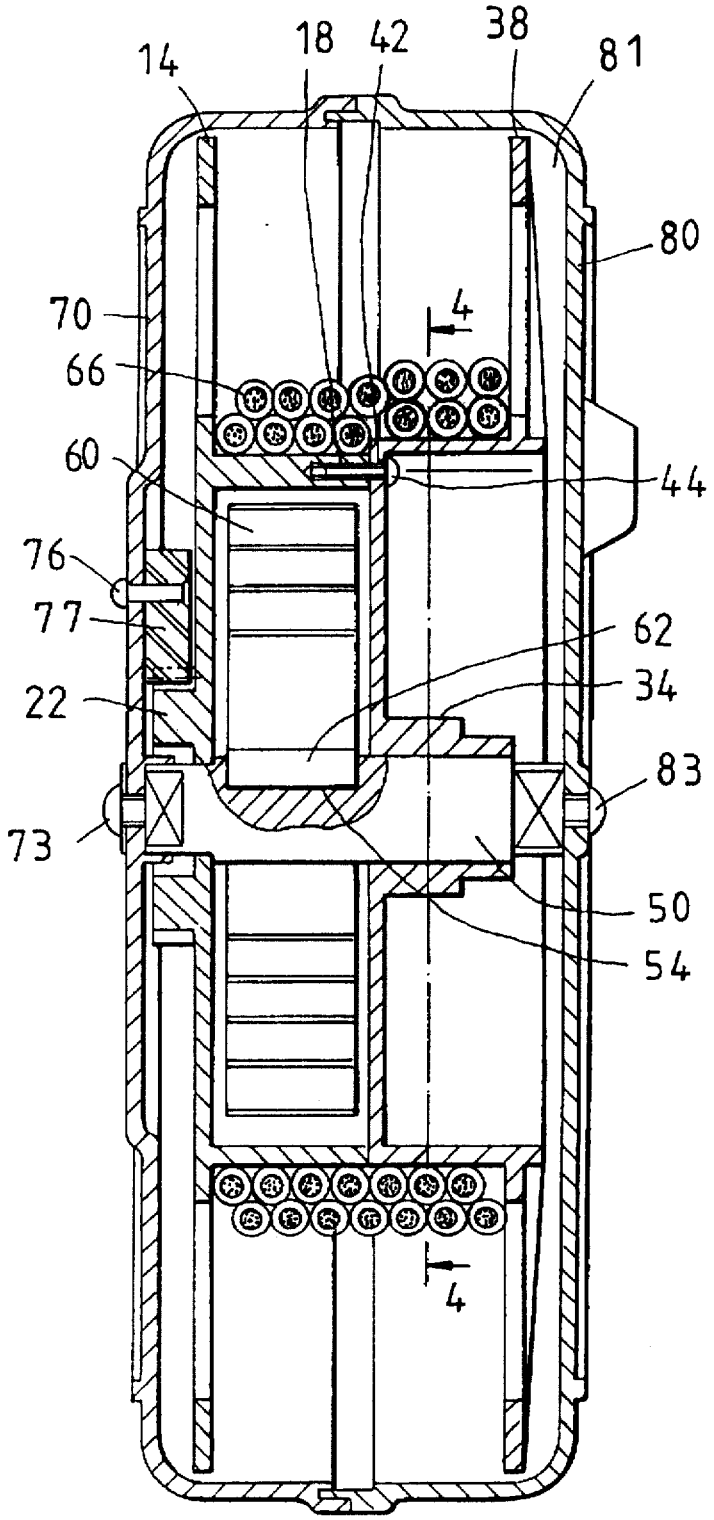
FIG. 3 shows a longitudinal sectional view of the present invention.

It must be noted here that each of the ribs 16 of the first cylindrical body 12 is composed of the axial hole 18 extending in the direction of the longitudinal axis of the ribs 16. The axial hole 18 is formed jointly by the wall body of the first cylindrical body 12 and two symmetrical arcuate portions 161 and 162 projecting respectively from the outer wall and the inner wall of the first cylindrical body 12, as shown in FIG. 2. The axial holes 18 of such a construction as described above does not undermine the bracing strength of the wall of the first cylindrical body 12. Each of the through holes 40 of the second cylindrical body 32 is formed jointly by the wall body of the second cylindrical body 32 and the arcuate portion 42 projecting from the outer wall of the second cylindrical body 32, as shown in FIG. 4.

The embodiment of the present invention described above is to be regarded in all respects as being merely illustrative and not restrictive. Accordingly, the present invention may by embodied in other specific forms without deviating from the spirit thereof. The present invention is therefore to be limited only by the scopes of the following appended claims.

What is claimed is:

1. A wire winding wheel comprising:

a first pulley made integrally of a plastic material by injection molding and composed of a first disk having at a center thereof a shaft hole, a first cylindrical body of a hollow construction and fastened at one end thereof with one side of said first disk, and a ratchet wheel fastened with another side of first disk such that said ratchet wheel is opposite in location to said first cylindrical body, said first cylindrical body provided in a wall body thereof with a plurality of ribs fastened therewith such that said ribs are arranged equidistantly, said ribs provided respectively with an axial hole, said first cylindrical body further provided on an inner wall thereof with a baffle fastened therewith;

a shaft received in said shaft hole of said first disk and provided respectively at both ends thereof with a retaining portion, said shaft further provided with a slot extending in the direction of a longitudinal axis of said shaft;

a spiral spring received in said first cylindrical body such that a curved portion of one end of said spiral spring is engaged with said slot of said shaft, and that another end of said spiral spring is received in a space located between said baffle and the surface of said inner wall of said first cylindrical body;

a second pulley made integrally of a plastic material by injection molding and composed of a second disk having a hub provided with an axial hole engageable with said shaft, said second pulley further composed of a second cylindrical body of a hollow construction and similar in diameter to said first cylindrical body and fastened at one end thereof with one side of said second disk, said second cylindrical body provided in a wall body thereof with a plurality of through holes corresponding in location and number to said axial holes of said ribs of said first cylindrical body of said first pulley for receiving a plurality of screws engageable with said axial holes of said ribs of said first cylindrical body;

a first housing made integrally of a plastic material by injection molding and provided with a first receiving space for housing said first pulley, said first housing still further provided in a side wall thereof with a cutout and a plurality of retaining projections, said first housing still further provided on a wall of a closed end thereof with a pin fastened therewith for pivoting an arrester capable of being caused by a biasing means to turn toward said shaft such that an arresting end of said arrester is engaged with said ratchet wheel for locating a wire wound on said first and said second cylindrical bodies, said first housing still further provided in an outer wall thereof with a plurality of fastening holes, said first receiving space of said first housing having a retaining hole engaged with said retaining portion located at one end of said shaft; and a second housing made integrally of a plastic material by injection molding and provided with a second receiving space for housing said second pulley, said second receiving space having a retaining hole engaged with said retaining portion located at another end of said shaft, said second housing further provided in a side wall thereof with a cutout corresponding in location to said cutout of said first housing for forming together a through hole for said wire to be pulled therethrough, said second housing still further provided in a side wall of an open end thereof with a plurality of retaining slots engaged securely with said retaining projections of said first housing, said second housing still further provided in an outer wall thereof with a plurality of fastening holes for receiving screws engageable with said fastening holes of said first housing, said second housing still further provided with a receptacle fastened therewith.

2. The wire winding wheel as defined in claim 1, wherein said ribs of said first cylindrical body of said first pulley have a longitudinal axis perpendicular to a surface of said one side of said first disk.

3. The wire winding wheel as defined in claim 2, wherein said ribs are three in number and arranged at an interval of 120 degrees.

4. The wire winding wheel as defined in claim 1, wherein said through holes of said second cylindrical body of said second pulley have a longitudinal center line perpendicular to a surface of said one side of said second disk.

5. The wire winding wheel as defined in claim 4, wherein said through holes are three in number and arranged at an interval of 120 degrees.

6. The wire winding wheel as defined in claim 1, wherein each of said axial holes of said ribs of said first cylindrical body is formed jointly by said wall body of said first cylindrical body and two symmetrical arcuate portions projecting respectively from an outer wall and an inner wall of said first cylindrical body.

7. The wire winding wheel as defined in claim 1, wherein each of said through holes of said second cylindrical body is formed jointly by said wall body of said second cylindrical body and an arcuate portion projecting from an outer wall of said second cylindrical body.

* * * * *